US009989316B2

(12) United States Patent
Lee

(10) Patent No.: US 9,989,316 B2
(45) Date of Patent: Jun. 5, 2018

(54) FIN-TUBE TYPE HEAT EXCHANGER

(71) Applicant: KYUNGDONG NAVIEN CO., LTD., Pyeongtaek-si, Gyeonggi-do (KR)

(72) Inventor: Dong Keun Lee, Seongnam-si (KR)

(73) Assignee: KYUNGDONG NAVIEN CO., LTD., Pyeongtaek-si (KR)

( * ) Notice: Subject to any disclaimer, the term of this patent is extended or adjusted under 35 U.S.C. 154(b) by 95 days.

(21) Appl. No.: 14/646,721

(22) PCT Filed: Nov. 18, 2013

(86) PCT No.: PCT/KR2013/010455

§ 371 (c)(1),
(2) Date: May 21, 2015

(87) PCT Pub. No.: WO2014/104576

PCT Pub. Date: Jul. 3, 2014

(65) Prior Publication Data

US 2015/0308756 A1 Oct. 29, 2015

(30) Foreign Application Priority Data

Dec. 26, 2012 (KR) ..... 10-2012-0153577

(51) Int. Cl.
*F28D 7/06* (2006.01)
*F28F 1/12* (2006.01)
(Continued)

(52) U.S. Cl.
CPC ..... *F28F 1/12* (2013.01); *F28D 1/05375* (2013.01); *F28F 1/32* (2013.01); *F28F 1/40* (2013.01);
(Continued)

(58) Field of Classification Search
CPC ..... F28F 1/12; F28F 1/32; F28F 13/12; F28F 1/40; F28F 1/42; F28F 2215/10; F28D 1/05375; F28D 21/0007; F28D 2021/0024
See application file for complete search history.

(56) References Cited

U.S. PATENT DOCUMENTS 2,677,394 A * 5/1954 Brinen ..... F01P 11/08 138/38
2,691,991 A 10/1954 Schutt et al. ..... 138/38
(Continued)

FOREIGN PATENT DOCUMENTS

EP 2 312 254 A1 4/2011
FR 2 946 420 A1 12/2010
(Continued)

OTHER PUBLICATIONS

International Search Report dated Feb. 21, 2014, issued to the corresponding International Application No. PCT/KR2013/010455.

*Primary Examiner* — Len Tran
*Assistant Examiner* — Jon T Schermerhorn
(74) *Attorney, Agent, or Firm* — Stein IP, LLC

(57) ABSTRACT

The present invention relates to a pin-tube type heat exchanger, comprising: tubes through the inside of which a heat medium flows and which are arranged in parallel with a uniform distance therebetween, so that a combustion product can pass through space between the tubes; and heat transfer fins which are separately coupled to the outer surface of the tubes along the longitudinal direction thereof, so as to be parallel to the direction of flow of the combustion product, wherein inside the tubes a first turbulent flow-generating member is installed for creating turbulence in the flow of the heat medium, wherein the first turbulent flow-generating member comprises a flat plate part, arranged in the longitudinal direction of the tubes, for dividing the inner space of the tubes into two sides, and first guide pieces and second guide pieces which are protrudingly provided at a tilted angle and are separately and alternately provided along the longitudinal direction of both sides of the flat plate part.

11 Claims, 10 Drawing Sheets

(51) Int. Cl.

| | |
|---|---|
| ***F28F 1/32*** | (2006.01) |
| ***F28F 1/40*** | (2006.01) |
| ***F28F 13/12*** | (2006.01) |
| ***F28D 1/053*** | (2006.01) |
| *F24H 1/40* | (2006.01) |
| *F28F 1/42* | (2006.01) |
| *F28D 21/00* | (2006.01) |

(52) U.S. Cl.
CPC ..... *F28F 13/12* (2013.01); *F24H 1/40* (2013.01); *F28D 21/0007* (2013.01); *F28D 2021/0024* (2013.01); *F28F 1/42* (2013.01); *F28F 2215/10* (2013.01)

(56) References Cited

U.S. PATENT DOCUMENTS

| | | | | |
|---|---|---|---|---|
| 4,106,558 | A | 8/1978 | Neveux | 165/190 |
| 5,901,641 | A | 5/1999 | McNamara | 99/403 |
| 5,975,199 | A * | 11/1999 | Park | F28F 1/325 165/151 |
| 7,013,843 | B1 | 3/2006 | Weintraub et al. | 122/367.3 |
| 2009/0255652 | A1 | 10/2009 | Brand et al. | 165/104.19 |
| 2012/0199327 | A1* | 8/2012 | Gaiser | F28D 1/05341 165/160 |

FOREIGN PATENT DOCUMENTS

| | | | |
|---|---|---|---|
| GB | 2 200 201 | A | 7/1988 |
| JP | S54-42069 | | 8/1977 |
| JP | S62-13958 | A | 1/1987 |
| JP | 6-6976 | U | 1/1994 |
| JP | H07-217999 | A | 8/1995 |
| JP | H09-269152 | A | 10/1997 |
| JP | 11-83196 | A | 3/1999 |
| JP | 2000-227294 | A | 8/2000 |
| JP | 2000-266488 | A | 9/2000 |
| JP | 2004-37005 | A | 2/2004 |
| KR | 1998-047520 | | 9/1998 |
| KR | 2000-0013895 | U | 7/2000 |
| KR | 2003-0056379 | A | 7/2003 |
| KR | 10-0484690 | B1 | 4/2005 |

* cited by examiner

FIN-TUBE TYPE HEAT EXCHANGER

TECHNICAL FIELD

The present invention relates to a fin-tube type heat exchanger in which a heat transfer fin is coupled to an outer surface of a tube to allow a heat medium flowing inside the tube to be heat-exchanged with a combustion product, and more particularly, to a fin-tube type heat exchanger in which a turbulent flow of each of a heat medium flowing inside a tube and a combustion product passing between heat transfer fins is promoted to restrain an occurrence of noise and improve heat efficiency.

BACKGROUND ART

In general, heating apparatuses include heat exchangers in which heat is exchanged between combustion products and heat media (heating water) by combustion of fuel to perform heating by using the heated heat media or supply hot water.

In the fin-tube type heat exchanger according to the related art, a tube in which a heat medium flows along an inner space thereof is coupled to a heat transfer fin protruding from a surface of the tube.

Referring to FIGS. 1 and 2, in the fin-tube type heat exchanger 1 according to the related art, a plurality of heat transfer fins 20 are parallely coupled to be spaced a predetermined distance from each other on outer surfaces of a plurality of tubes 10 each of which has a rectangular section, and a plurality of insertion holes 21 each of which has a shape corresponding to that of each of the tubes 10 are defined in the heat transfer fins 20 to allow the tubes 10 to be inserted therein. Here, portions where the outer surfaces of the tubes 10 contact the insertion holes 21 are welded and coupled to each other. End plates 30 and 40 are respectively bonded and connected to both ends of the tubes 10 to which the heat transfer fins 20 are coupled. Also, a plurality of insertion holes 31 and 41 each of which has a shape corresponding to that of each of the tubes 10 are defined in the end plates 30 and 40 to allow both ends of the tubes 10 to be inserted therein and then to be welded and coupled thereto. Flow path caps 50 (51, 52, and 53) are coupled to a front side of the end plate 30, and flow path caps 60 (61 and 62) are coupled to a rear side of the end plate 40, and thus a flow path of the heat medium flowing inside the tubes 10 is switched. Also, an inlet 51*a* and outlet 53*a* of the heat medium are disposed on the flow path caps 51 and 53, respectively.

Since such a fin-tube type heat exchanger has high heat-exchanging efficiency when compared to different types of heat exchangers and a simple structure, the fin-tube type heat exchanger may be manufactured in a compact size. Also, since the fin-tube type heat exchanger has high mass productivity, the fin-tube type heat exchanger is being widely utilized for domestic and industrial uses such as a boiler and air conditioner. Also, since the fin-tube type heat exchanger has a small size and secures a wide heat transfer area, the fin-tube type heat exchanger has excellent heat efficiency when compared to a heat exchanger to which a Hi-fin or corrugated tube is applied.

However, in the fin-tube type heat exchanger according to the related art, as illustrated in FIG. 3, a lower end 10*a* of the tube 10 disposed at a side into which the combustion product generated by the combustion of a burner 70 is introduced may be locally overheated to generate bubbles B in the heat medium passing inside the tube 10, thereby causing boiling noises. Also, foreign substances such as calcium contained in the heat medium adheres to an area on which the flow inside the tube 10 is delayed to significantly deteriorate efficiency of the heat exchanger. In a severe case, the area to which the foreign substances adhere may be damaged due to the overheating.

There are prior arts for solving the above-described limitations, that is, a boiling prevention member of a heat exchanger in which a plurality of blades tilted at a predetermined angle are inserted to switch a flow path of heating water in a tube (heating tube) is disclosed in Korean Utility Publication Gazette No. 20-1998-047520, and a tube (heating tube) having spiral grooves defined in a predetermined section on an inner surface of the tube so that heating water rotates to be mixed while passing through the spiral grooves is disclosed in Korean Utility Publication Gazette No. 20-1998-047521. However, these prior arts are applicable to a case in which the tube has a circular section. Thus, when a rectangular tube having a relatively large heat transfer area to a unit through area is used instead of the circular tube so as to develop a compact heat exchanger having high efficiency by further increasing heat-exchange efficiency, since the boiling prevention member or the spiral grooves disclosed in the prior art documents are not easily adopted inside the tube having a high rectangle ratio, the related art are not applicable.

Referring to FIG. 4, in the fin-tube type heat exchanger according to the related art, each of the heat transfer fins 20 has a flat plate shape, and the combustion product linearly passes between the heat transfer fins 20 parallely disposed adjacent to each other. In this case, as illustrated in FIG. 5, a temperature at a portion on which the combustion product contacts the heat transfer fin 20 is maintained at a temperature T∞ over a predetermined section A from a start end of the heat transfer fin 20 to which the combustion product is introduced, and then the combustion product changes to a temperature T0. Here, a point at which the combustion product starts at the temperature T0 may be called a temperature boundary layer formation point B. After the temperature boundary layer formation point B, a portion at which the combustion product contacts the heat transfer fin 20 becomes to a temperature T0, as the combustion product is away from the heat transfer fin 20, the fluid increases up to the temperature T∞.

In this case, a point at which the combustion product has a relatively low temperature is expressed by an oblique line in FIG. 5. Thus, when the heat transfer fin 20 is processed in a flat plate shape, the heat exchange efficiency decreases on an area after the temperature boundary layer formation point B. Also, when the heat transfer fins 20 are disposed with a narrow distance ace therebetween so that the temperature boundary layer formation point B is far away from the start end of the heat transfer fin 20, the combustion product increases in flow resistance to deteriorate the heat efficiency.

DISCLOSURE OF THE INVENTION

Technical Problem

An object of the present invention is to provide a fin-tube type heat exchanger in which an occurrence of a turbulent flow of a heat medium flowing inside a tube of the fin-tube type heat exchanger is promoted to prevent heat efficiency deterioration and damage of the tube from occurring, which are caused by boiling noises due to the local overheating of the tube and adhesion of foreign substances contained in the heat medium.

Another object of the present invention is to provide a fin-tube type heat exchanger capable of guiding a flow of a combustion product passing between heat transfer fins in various directions to promote an occurrence of a turbulent flow of the combustion product, thereby being improved in heat exchange efficiency.

Technical Solution

A fin-tube type heat exchanger according to the present invention to realize the above-describe objects includes: tubes 110 through which a heat medium flows, the tubes 110 being parallely disposed at a predetermined distance to allow a combustion product to pass through a space therebetween; and heat transfer fins 150 spaced apart from each other and coupled to an outer surfaces of the tubes 110 along a longitudinal direction so that the heat transfer fins are disposed parallel to a flow direction of the combustion product, wherein a first turbulent flow-generating member 130 for generating a turbulent flow in the heat medium is disposed inside each of the tubes 110, wherein the first turbulent flow-generating member 130 includes: a flat plate part 131 disposed in the longitudinal direction of the tube 110 to divide an inner space of the tube 110 into two spaces; and first and second guide pieces 132 and 133 spaced apart from each other along the longitudinal direction to alternately protrude inclined from both side surfaces of the flat plate part 131.

In this case, the first guide piece 132 may be disposed inclined on one surface of the flat plate part 131 so that the heat medium flows upward, the second guide piece 133 may be disposed inclined on the other surface of the flat plate part 131 so that the heat medium flows downward, and the heat medium introduced into the first and second guide pieces 132 and 133 are successively guided to second and first guide pieces 133 and 132 disposed adjacent to an opposite surface of the flat plate part 131 to alternately flow through both spaces of the flat plate part 131.

Also, a heat medium inflow end of the first guide piece 132 may be connected to a lower end of the flat plate part by a first connection piece 132*a*, and simultaneously, a first communication hole 132*b* through which a fluid communicates with both spaces of the flat plate part 131 is defined between the lower end of the flat plate part 131, the first connection piece 132*a*, and the first guide piece 132, and a heat medium discharge end of the first guide piece 132) may be disposed at a height adjacent to an upper end of the flat plate part 131, and a heat medium inflow end of the second guide piece 133 may be connected to the upper end of the flat plate part 131 by a second connection piece 133*a*, and simultaneously, a second communication hole 133*b* through which the fluid communicates with both spaces of the flat plate part 131 is defined between the upper end of the flat plate part 131, the second connection piece 133*a*, and the second guide piece 133, and a heat medium discharge end of the second guide piece 133 may be disposed at a height adjacent to the lower end of the flat plate part 131.

Also, a portion of the flat plate part 131 may be cut and bent in both directions of the flat plate part 131 to form the first and second guide pieces 132 and 133, and the fluid may communicate with both spaces of the flat plate part 131 through the cut portions of the first and second guide pieces 132 and 133.

Also, a third guide piece 134 having a tilted angle that is different from that of the first guide piece 132 to cross the first guide piece 132 may protrude from one surface of the flat plate part 131, and a fourth guide piece 135 having a tilted angle that is different from that of the second guide piece 133 to cross the second guide piece 133 may protrude from the other surface of the flat plate part 131.

Also, welding parts 136 and 137 may protrude respectively from front and rear ends of the flat plate part 131 in both directions and are welded and coupled to an inner surface of the tube 110.

Also, an inflow tube 120*a* and a discharge tube 120*b* of the heat medium may be disposed at both sides of the tubes 110, respectively, and a second turbulent flow-generating member 140 for generating a turbulent flow of the heat medium may be disposed in each of the inflow tube 120*a* and the discharge tube 120*b*, wherein the second turbulent flow-generating member 140 may include: a plate member 141 disposed in each of the inflow tube 120*a* and the discharge tube 120*b* in the longitudinal direction to vertically divide the inside of each of the inflow tube 120*a* and the discharge tube 120*b*; and first and second inclined parts 144 and 145 spaced apart from each other along a flow direction of the heat medium and formed by cutting a portion of the plate member 141, the first and second inclined parts 144 and 145 being alternately bent inclined in a vertical direction.

Also, each of the first and second inclined parts 144 and 145 disposed adjacent to each other along the flow direction of the heat medium may be alternately inclined in upward and downward directions.

Also, plurality of louvers 155, 156, and 157 having sizes and tilted angles different from each other may be disposed on each of the heat transfer fins 150 along a flow direction of the combustion product introduced between the heat transfer fins disposed adjacent to each other.

Also, a portion of the heat transfer fin 150 may be cut to be bent in one direction to form the plurality of louvers 155, 156, and 157, and the fluid may communicate with both sides of the heat transfer fin 150 through the cut portions of the heat transfer fin 150.

Also, the louvers 155, 156, and 157 are disposed on an area after a temperature boundary point B of the combustion product.

Also, each of the tubes 110 may have a rectangular section of which a side parallel to a flow direction of the combustion product has a length longer than that of a side of inflow and discharge-sides of the combustion product.

Advantageous Effects

In the fin-tube type heat exchanger according to the present invention, since the first and second turbulent flow-generating members for switching the flow direction of the heat medium are disposed in the tube and heat medium inflow and discharge tubes, the occurrence of the turbulent flow of the heat medium may be promoted to prevent the occurrence of the boiling noises and heat efficiency deterioration caused by adhesion and sedimentation of the foreign substances contained in the heat medium due to the local overheating of the tube.

Also, since the plurality of louvers having sizes and tilted angles different from each other are alternately formed in the heat transfer fin along the flow direction of the combustion product, the occurrence of the turbulent flow may be promoted to improve heat exchange efficiency. Also, since the louvers are disposed only on the area after the temperature boundary point of the heat transfer fin, the combustion product may be reduced in flow resistance when compared to the case in which the louvers are disposed on the entire area of the heat transfer fin. Also, time and costs for processing the louvers may be reduced.

Also, since the heat exchanger increases in heat exchanger efficiency even though the installation number of the tube is reduced when compared to the heat exchanger according to the related art, the heat exchanger may decreases in entire volume and thus be manufactured in compact size.

Descriptions of reference symbols and numerals

| | |
|---|---|
| 1: Heat exchanger | 10: Tube |
| 20: Heat transfer fin | 30, 40: End plates |
| 50, 60: Flow path caps | 70: Burner |
| 100: Heat exchanger | 110: Tube |
| 120a: Inflow tube | 120b: Discharge tube |
| 130: First turbulent flow-generating member | 131: Flat plate part |
| 132: First guide piece | 132a: First connection piece |
| 132b: First communication hole | 133: Second guide piece |
| 133a: Second connection piece | 133b: Second communication hole |
| 134: Third guide piece | 135: Fourth guide piece |
| 136, 137: Welding parts | 140: Second turbulent flow-generating member |
| 141: Plate member | 142: Side surface |
| 143: Connection part | 144: First inclined part |
| 145: Second inclined part | 150: Heat transfer fin |
| 151: Flat plate member | 152: Tube insertion hole |
| 153: Inflow tube insertion hole | 154: Discharge tube insertion hole |
| 155, 156, 157: Louver rings | |
| 155a, 156a, 157a: Communication holes | |
| 160, 170: End plates | 180, 181, 182, 183, 190, 191, 192: Flow path caps |

MODE FOR CARRYING OUT THE INVENTION

Hereinafter, components and effects of preferred embodiments according to the present invention will be described in detail with reference to the accompanying drawings.

Figure 1:
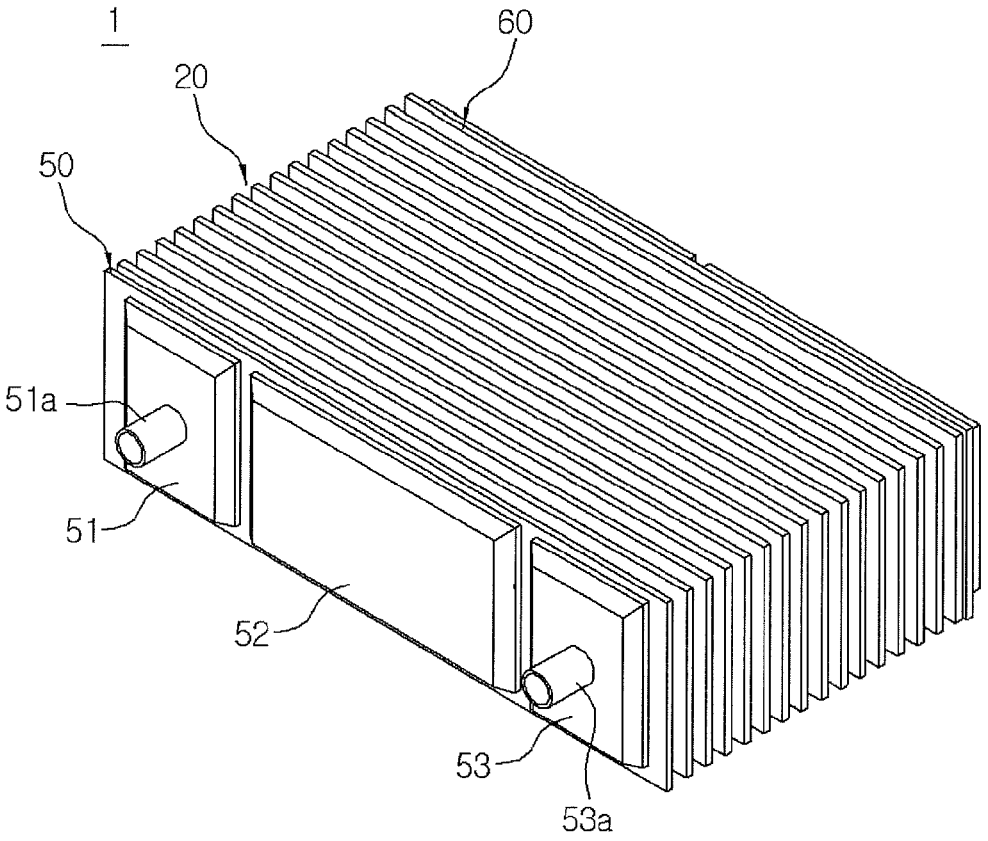
FIG. 1 is a perspective view of a fin-tube type heat exchanger according to a related art.
Figure 2:
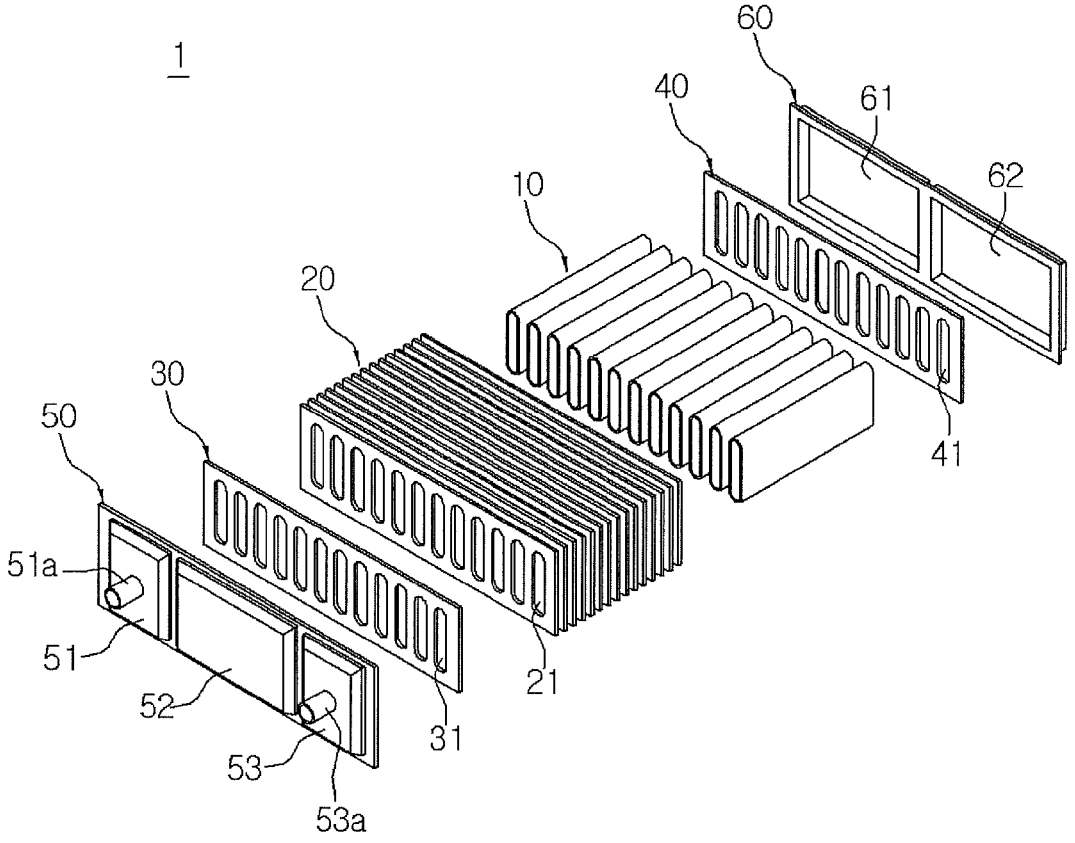
FIG. 2 is an exploded perspective view of FIG. 1.
Figure 3:
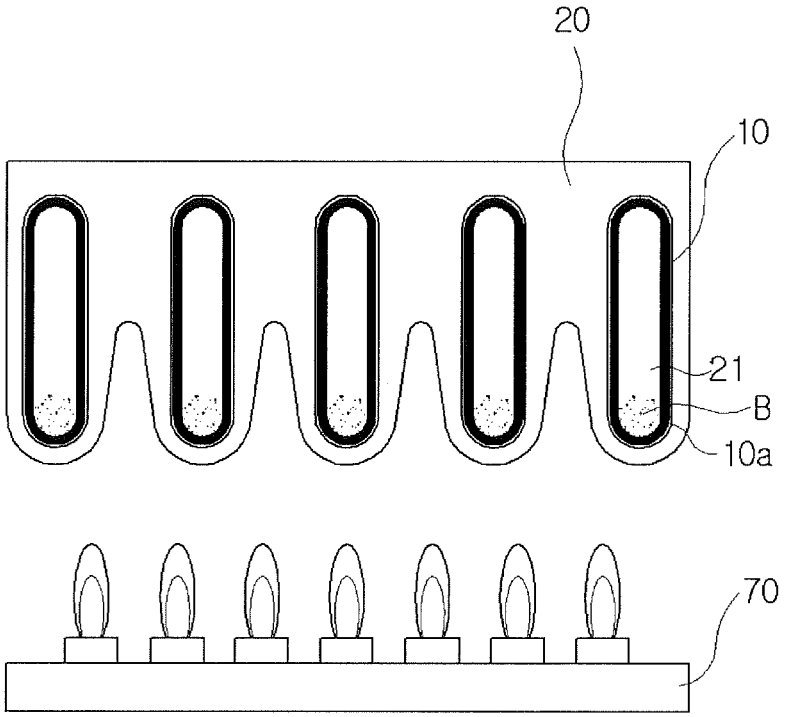
FIG. 3 is a view explaining limitations of boiling noise generation and foreign substance adhesion in the fin-tube type heat exchanger according to the related art.
Figure 4:
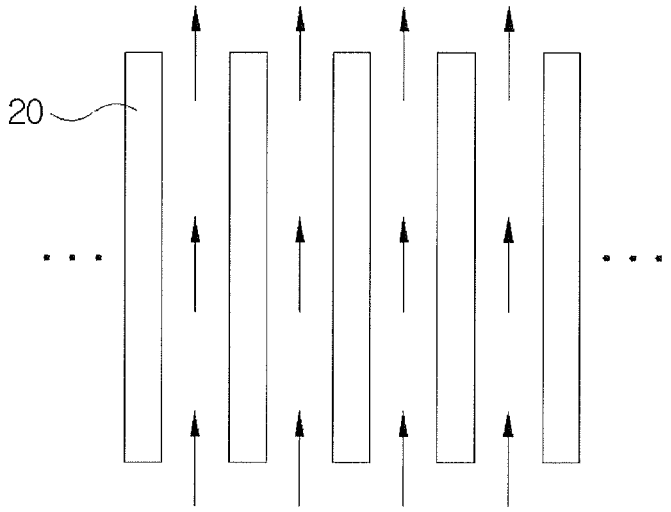
FIG. 4 is a view illustrating a state in which a combustion product passes between flat plate shape heat transfer fins according to the related art.
Figure 5:
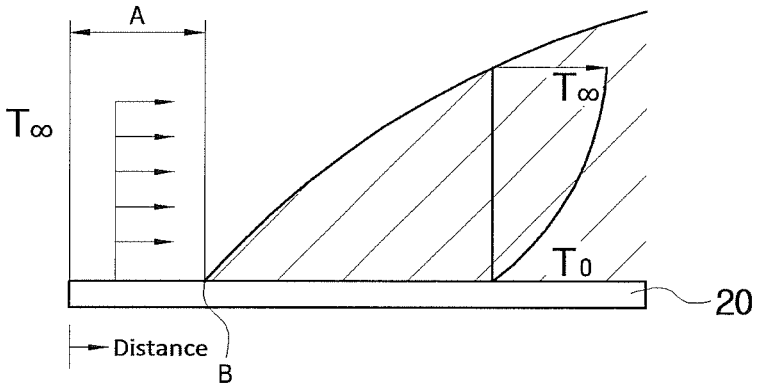
FIG. 5 is a view of a boundary layer of a temperature.
Figure 6:
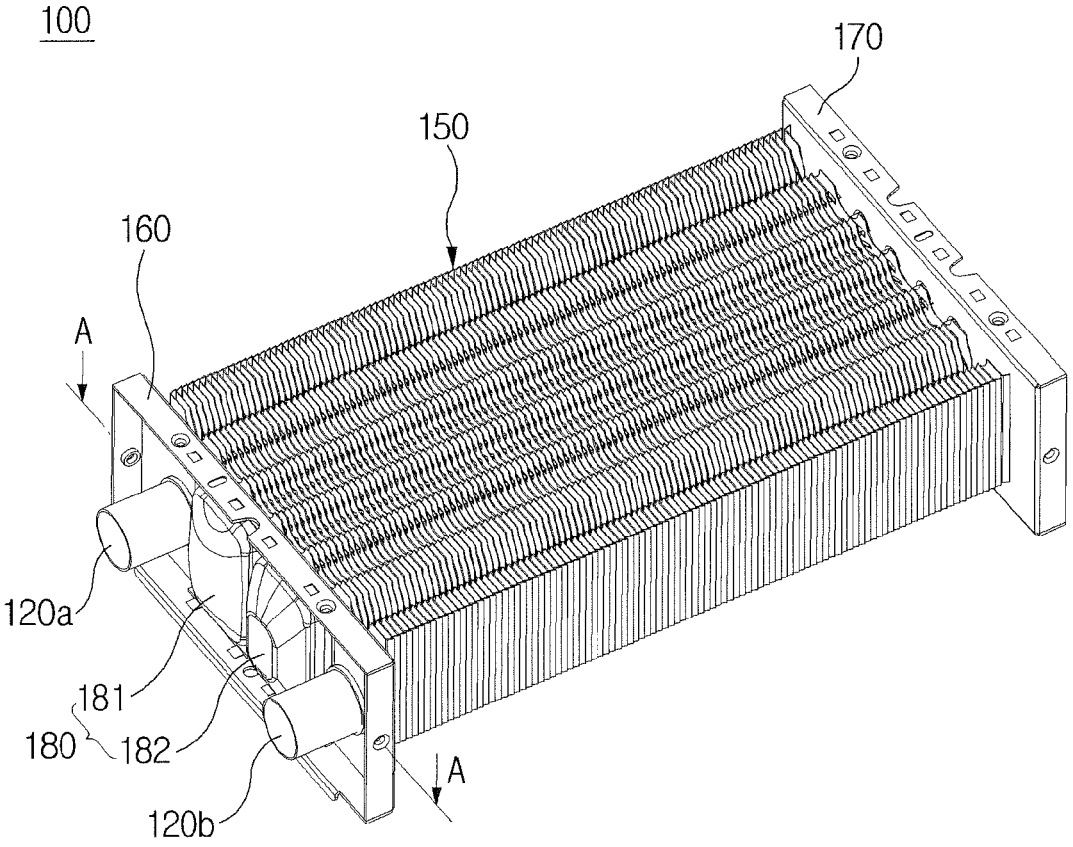
FIGS. 6 and 7 are perspective views of a fin-tube type heat exchanger according to the present invention when viewed from directions different from each other.
Figure 7:
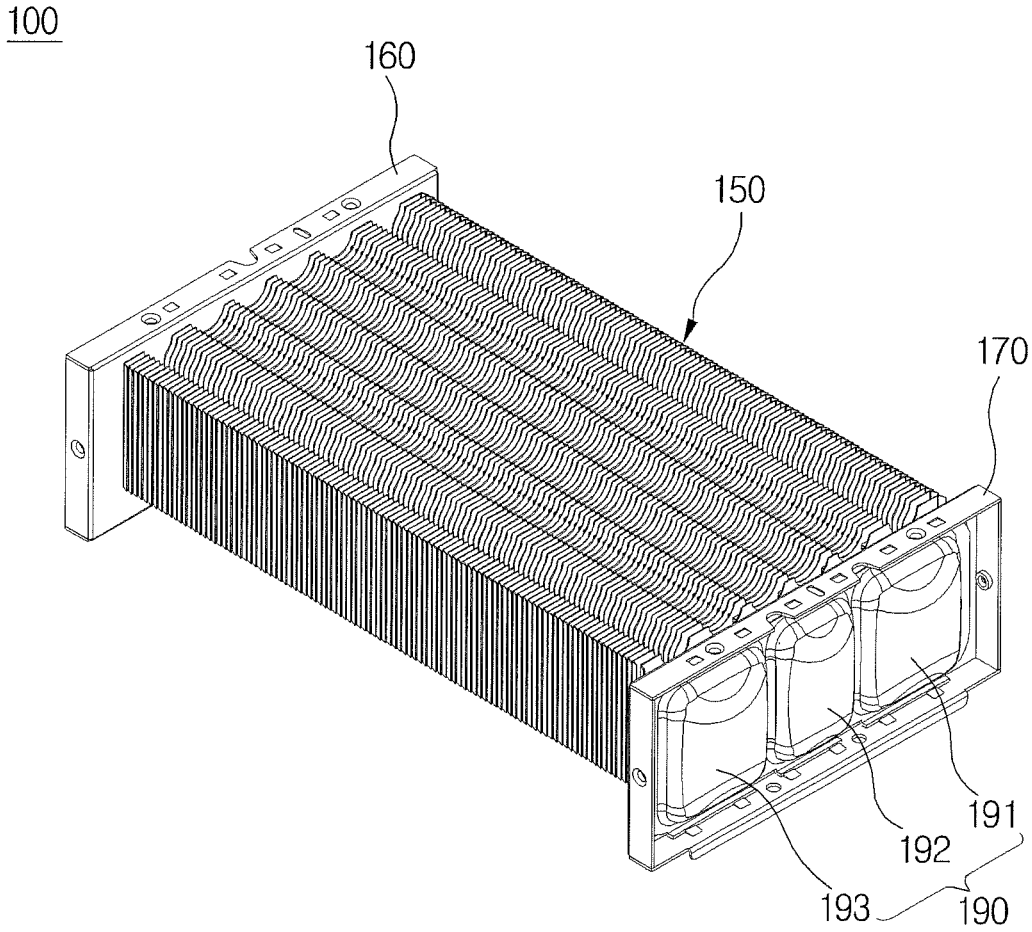
Figure 8:
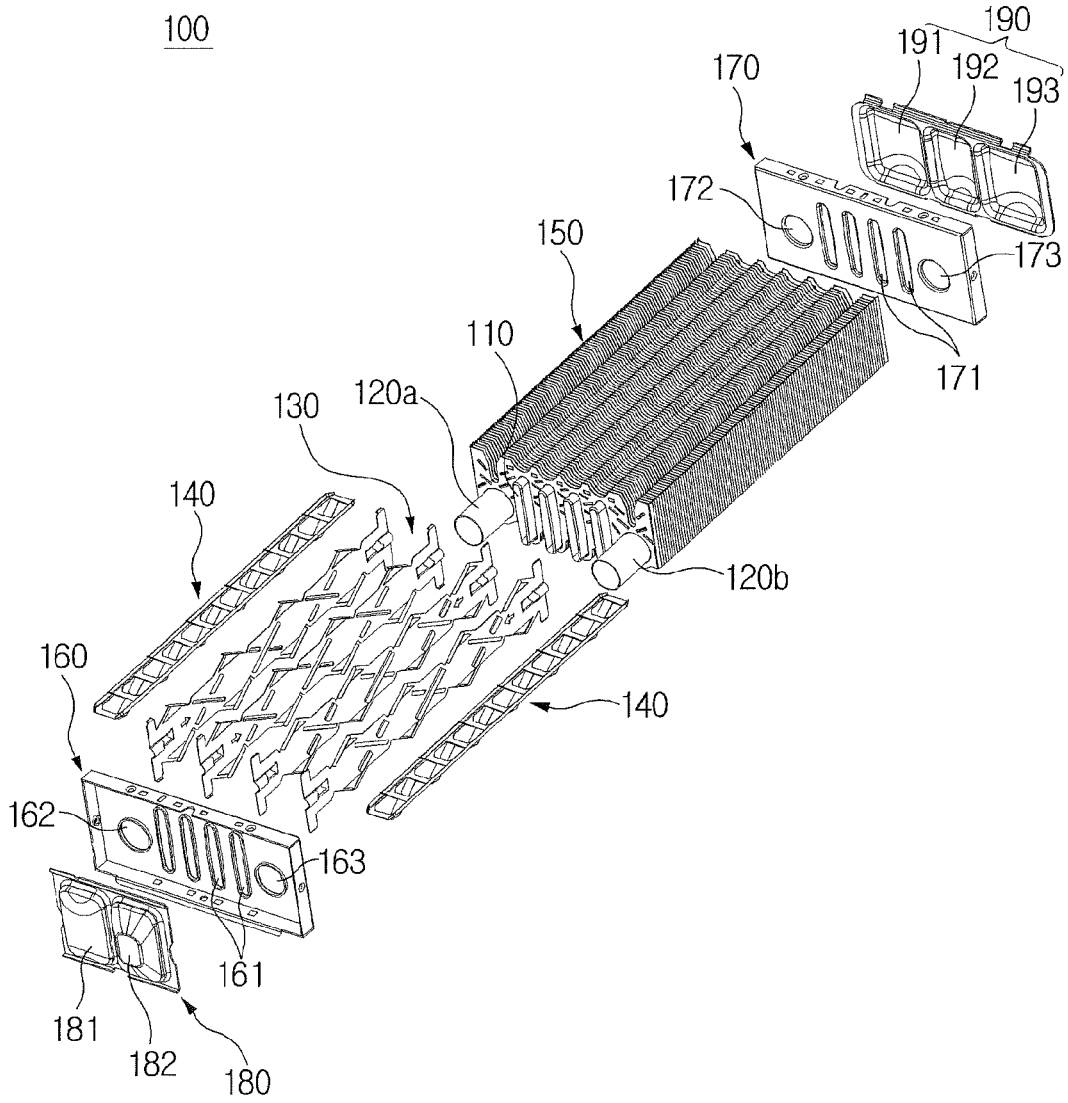
FIG. 8 is an exploded perspective view of FIG. 6.
Figure 9:
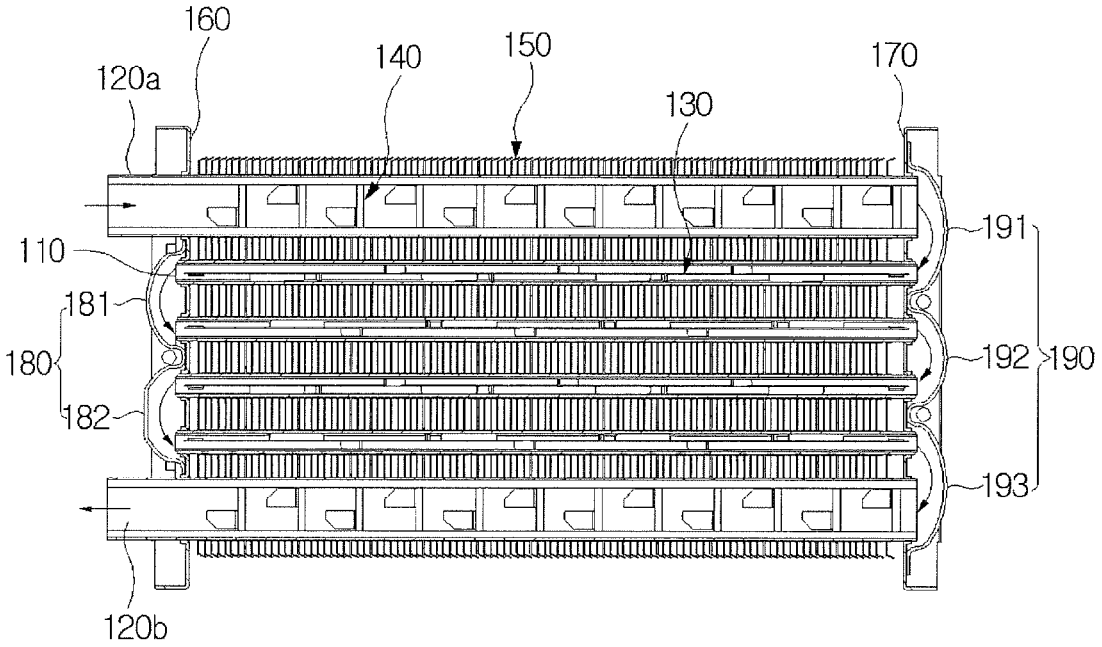
FIG. 9 is a cross-sectional view taken along line A-A' of FIG. 6.

FIGS. 6 and 7 are perspective views of a fin-tube type heat exchanger according to the present invention when viewed from directions different from each other, and FIG. 8 is an exploded perspective view of FIG. 6, and FIG. 9 is a cross-sectional view taken along line A-A' of FIG. 6.

In a fin-tube type heat exchanger 100 according to the present invention, a turbulent flow is generated in a flow of a heat medium passing inside a heat medium inflow tube 120*a*, a tube 110, and a heat medium discharge tube 120*b* disposed to pass inside the heat exchanger 100 to prevent the heat medium from boiling and foreign substances from adhering which are caused by local overheating in the tube 110, and also, a turbulent flow is generated in a flow of a combustion product passing between heat transfer fins 150 to improve heat exchange efficiency between the combustion product and the heat transfer fins 150. Hereinafter, an entire structure of the heat exchanger 100 will be firstly described, and detailed descriptions with respect to specific components of the present invention to promote turbulent flow generation of the heat medium and combustion product will be described later.

Figure 14:
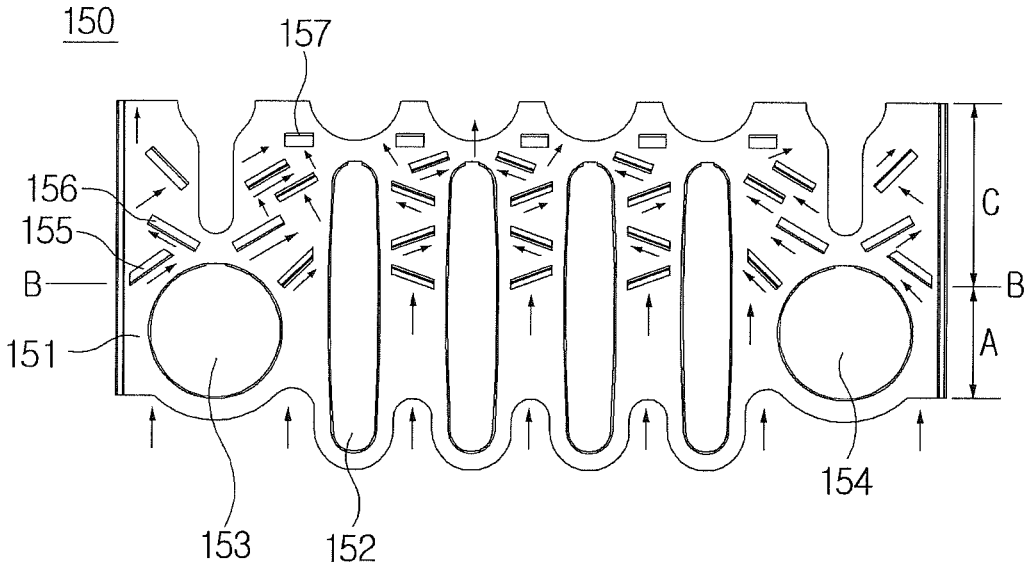
FIG. 14 is a view illustrating a flow of a fluid passing between the heat transfer fins.

Referring to FIGS. 6 to 9, a plurality of tubes 110 in which the heat medium passes are parallely disposed in a predetermined distance. The inflow tube 120*a* and discharge tube 120*b* of the heat medium are disposed on both sides of the plurality of tubes 110. A plurality of heat transfer fins 150 are coupled to outer surfaces of the plurality of tubes 110, the inflow tube 120*a*, and discharge tube 120*b* in a predetermined distance along a longitudinal direction. Referring to FIG. 14, a tube insertion hole 152, an inflow tube insertion hole 153, and a discharge tube insertion hole 154 are defined in each of the heat transfer fins 150 so that each of the tubes 110, the inflow tube 120*a*, and the discharge tube 120*b* are inserted and coupled thereto.

It is preferable that the tube 110 may have a rectangular section of which a side parallel to a flow direction of the combustion product has a length that is longer than that of a side at inflow and discharge-sides of the combustion products to widely secure a heat transfer area.

As a component for promote turbulent flow generation in the flow of the heat medium circulating in the heat exchanger 100, first turbulent flow-generating members 130 are coupled to the inside the plurality of tubes 110, and second turbulent flow-generating members 140 are coupled to the inside the inflow tube 120*a* and the discharge tube 120*b*.

In the current embodiment, each of the first turbulent flow-generating members 130 has a structure suitable for generating a turbulent flow of the heat medium passing through rectangular tube 110, and each of the second turbulent flow-generating members 140 has a structure suitable for generating a turbulent flow of the heat medium passing through the circular inflow tube 120*a* and discharge tube 120*b*. Detailed descriptions of the first and second turbulent flow-generating members 130 and 140 will be described later.

End plates 160 and 170 are connected and connected to both ends of the tube 110 to which the heat transfer fin 150 is coupled. A plurality of insertion holes 161 and 171 having shapes corresponding to those of the tubes 110 are defined in the end plates 160 and 170, respectively. Also, insertion holes 162 and 163 through which one end of each of the inflow tube 120*a* and discharge tube 120*b* passes are defined in the end plate 160 disposed at a front side. Also, insertion holes 172 and 173 to which the other end of each of the inflow tube 120*a* and discharge tube 120*b* is connected and connected are defined in the end plate 170 disposed at a rear side. Both ends of the tube 110 are inserted into and then coupled to the insertion holes 161 and 171 of the end plates 160 and 170 by welding. Outer circumferential surfaces of the inflow tube 120*a* and discharge tube 120*b* are inserted into and then coupled to the insertion holes 162 and 163 of the end plate 160 by welding, respectively. Also, rear ends of the inflow tube 120*a* and discharge tube 120*b* are inserted into and then coupled to the insertion holes 172 and 173 of the end plate 170 by welding, respectively.

Flow path caps 180 (181 and 182) are coupled to a front side of the end plate 160, and flow path caps 190 (191, 192, and 193) are coupled to a rear side of the end plate 170. As illustrated in FIG. 9, the heat medium introduced through the inflow tube 120*a* may be alternately switched in flow path from the front side to rear side and from the rear side to the front side by the flow path caps 180 and 190 to successively pass through the plurality of tubes 110, thereby being discharged through the discharge hole 120*b*. During this flow process, the heat medium may heat exchanged with the combustion product and thus be heated.

Figure 10:
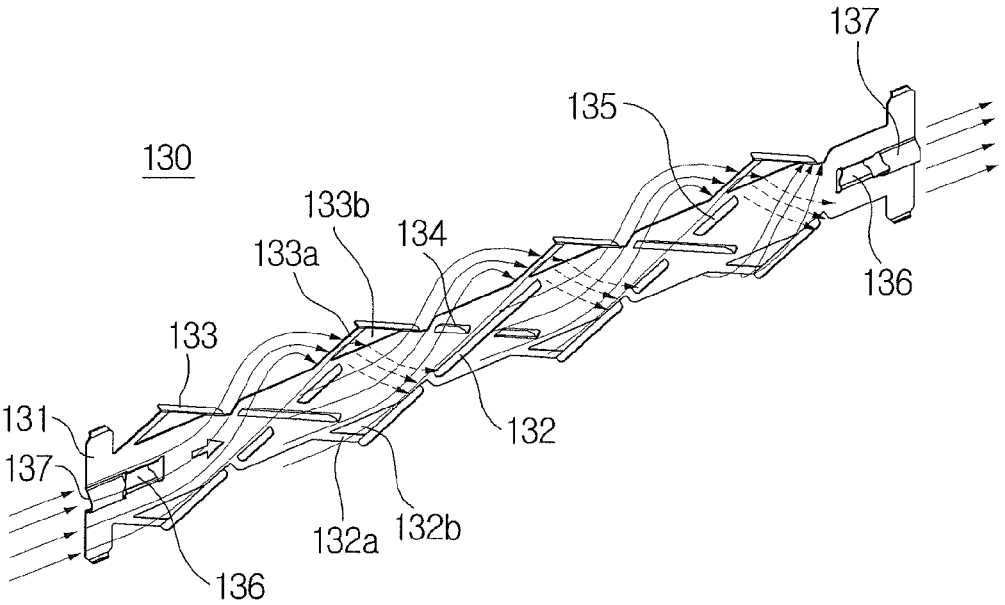
FIG. 10 is a perspective view illustrating a first turbulent flow-generating member disposed in a tube and a flow of a heat medium.
Figure 11:
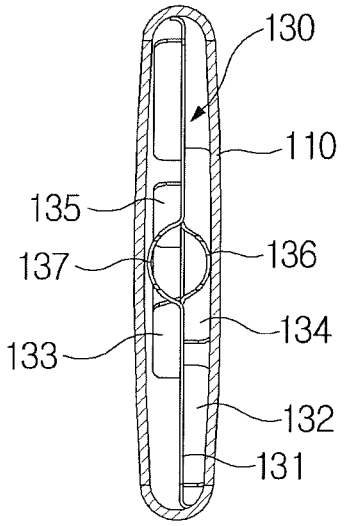
FIG. 11 is a cross-sectional view illustrating a state in which the first turbulent flow-generating member is coupled to the inside the tube.

Hereinafter, components and effects of the first turbulent flow-generating member 130 disposed inside the tube 110 will be described with reference to FIGS. 10 and 11. FIG. 10 is a perspective view illustrating a first turbulent flow-generating member disposed in a tube and a flow of a heat medium and FIG. 11 is a cross-sectional view illustrating a state in which the first turbulent flow-generating member is coupled to the inside the tube.

The first turbulent flow-generating member 130 may generate a turbulent flow in the flow of the heat medium flowing along the inside of the tubes 110 to prevent the tube 110 disposed at the inflow side of the combustion product from being locally overheated, thereby preventing boiling noises and adhesion of the foreign substances from occurring.

For this, the first turbulent flow-generating member 130 has a structure in which a flat plate part 131 is disposed in the longitudinal direction of the tube 110 to divide an inner space of the tube 110 into two spaces, and first and second guide pieces 132 and 133 are inclinedly disposed on both side surfaces of the flat plate part 131 and spaced apart from each other along a longitudinal direction of the flat plate part 131.

The first guide pieces 132 are spaced a predetermined distance from each other on one surface of the flat plate part 131 and tilted upward with respect to a horizontal line from a front end to which the heat medium is introduced toward a rear end through which the heat medium passes. The second guide pieces 133 are spaced a predetermined distance from each other on the other surface of the flat plate part 131 and tilted downward with respect to the horizontal line from the front end to which the heat medium is introduced toward the rear end through which the heat medium passes.

That is, the first and second guide pieces 132 and 133 having upward and downward tilted angles different from each other are disposed at positions corresponding to each other on both side surfaces of the flat plate part 131. Thus, the heat medium introduced into one space of the flat plate part 131 may flow upward inside the tube 110 by the first guide piece 132. Also, the heat medium introduced into the other space of the flat plate part 131 may flow downward inside the tube 110 by the second guide piece 133.

A heat medium inflow end of the first guide piece 132 is connected to a lower end of the flat plate part 131 by a first connection piece 132*a*, and at the same time, a first communication hole 132*b* through which the fluid communicates with both spaces of the flat plate part 131 is defined between the lower end of the flat plate part 131, the first connection piece 132*a*, and the first guide piece 132. Also, a heat medium discharge end of the first guide piece 132 is disposed adjacent to an upper end of the flat plate part 131.

Also, a heat medium inflow end of the second guide piece 133 is connected to the upper end of the flat plate part 131 by a second connection piece 133*a*, and at the same time, a second communication hole 133*b* through which the fluid communicates with both spaces of the flat plate part 131 is defined between the upper end of the flat plate part 131, the second connection piece 133*a*, and the second guide piece 133. Also, a heat medium discharge end of the second guide piece 133 is disposed adjacent to the lower end of the flat plate part 131.

According to this structure, the heat medium moved upward from the one side of the flat plate part 131 by the first guide piece 132 may pass through the second communication hole 133*b* defined in the other side of the flat plate part 131 at the rear side to move into the other space of the flat plate part 131. Then, the heat medium may move downward from the other side of the flat plate part 131 by the second guide piece 133 to pass through the first communication hole 132*b* defined in one side of the flat plate part 131 to move again into the one space of the flat plate part 131. Thus, the heat medium may be continuously switched in flow direction in upward/downward and left/right directions inside the tube 110 by the first and second guide pieces 132 and 133, and thus turbulent flow in which the fluid is agitated may be generated in the heat medium.

Also, a portion of the flat plate part 131 is cut and bent outward to define a portion of the first guide piece 132 and a portion of the second guide piece 133 of entire portions of the first and second guide pieces 132 and 133, which are disposed both side surfaces of the flat plate part 131. For example, three sides of four sides of the rectangular flat plate part 131 are cut and bent with respect to the rest one side. In this case, the heat medium may be switched in flow direction into the upward or downward direction by the curved protruding surface. Also, the fluid may communicate with the both spaces of the flat plate part 131 through the cut portions to further promote the turbulent flow.

Also, a third guide piece 134 having a tilted angle different from that of the first guide piece 132 to cross the first guide piece 132 protrudes from the one surface of the flat plate part 131. Also, a fourth guide piece 135 having a tilted angle different from that of the second guide piece 133 to cross the second guide piece 133 protrudes from the other surface of the flat plate part 131. Here, a portion of the flat plate part 131 may be cut to be bent both sides to define the third and fourth guide pieces 134 and 135. The fluid may communicate with both spaces of the flat plate part 131 through the cut portions.

Like this, since the third and fourth guide pieces 134 and 135 are additionally disposed on both side surfaces of the flat plate part 131, the upward flow may be mixed with the downward flow in each of both sides of the flat plate part 131 to further promote the turbulent flow of the heat medium.

Also, as illustrated in FIG. 11, welding parts 136 and 137 protrude from the front and rear ends of the flat plate part 131 in both directions so that the welding parts 136 and 137 contact an inner surface of the tube 110. Thus, the welding parts 136 and 137 are welded and coupled to the inner surface of the tube 110. Therefore, area and number of a welding portion may be reduced to simplify a structure the first turbulent flow-generating member 130 is coupled to the inside the tube 110. In the current embodiment, although the protruding shapes of the welding parts 136 and 137 are provided with semicircular shapes, the protruding shapes are not limited thereto and may vary other shapes.

Figure 12:
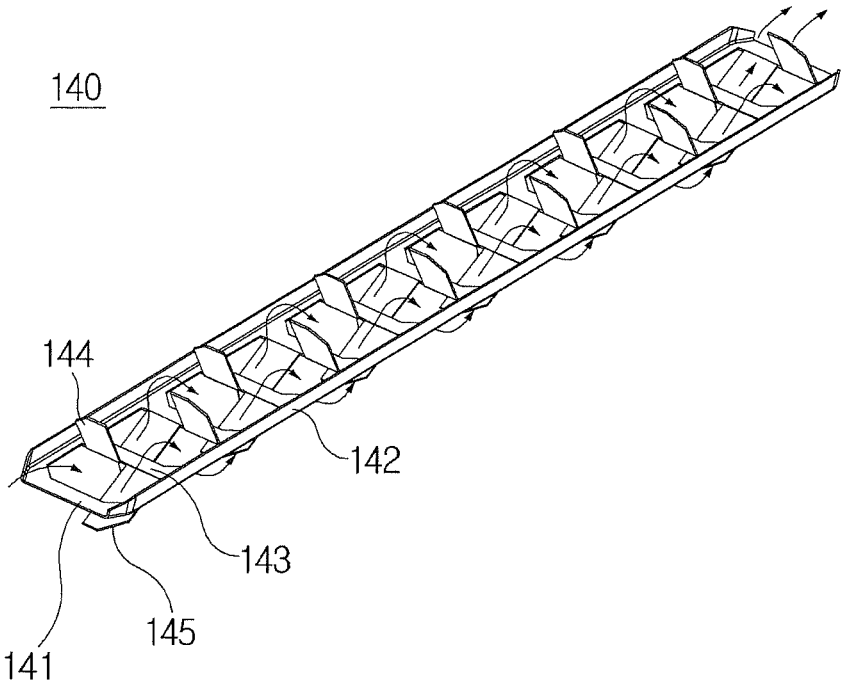
FIG. 12 is a perspective view illustrating a second turbulent flow-generating member disposed inside each of an inflow tube and a discharge tube of the heat medium and a flow of the heat medium.

Hereinafter, components of the second turbulent flow-generating member 140 disposed in the inflow tube 120*a* and discharge tube 120*b* will be described. FIG. 12 is a perspective view illustrating a second turbulent flow-generating member disposed inside each of an inflow tube and a discharge tube of the heat medium and a flow of the heat medium.

The second turbulent flow-generating member 140 includes a plate member 141 disposed in the longitudinal direction of the inflow tube 120*a* and discharge tube 120*b* to vertically divide an inner space of each of the inflow tube 120*a* and the discharge tube 120*b* and first and second inclined parts 144 and 145 spaced apart from each other with a connection member 143 therebetween along a flow direction of the heat medium and formed by cutting a portion of the plate member 141 and inclinedly alternately bending the cut portions in a vertical direction.

Each of the first and second inclined parts 144, 145 disposed adjacent to each other along the flow direction of the heat medium are alternately inclined in upward and downward directions. Thus, as shown by an arrow of FIG. 12, the heat medium passing inside the inflow tube 120*a* and the discharge tube 120*b* may have a turbulent flow in which the flow direction of the heat medium is alternately switched in upward and downward directions by the first and second inclined parts 144 and 145 of the second turbulent flow-generating member 140.

In the second turbulent flow-generating member 140, both side surfaces 142 of the plate member 141 are inserted into the inflow tube 120*a* and the discharge tube 120*b* so that side surfaces 142 of the plate member 141 are closely attached to an inner surface of each of the inflow tube 120*a* and the discharge tube 120*b*, and front and rear ends of the side surface 142 are coupled to the inflow tube 120*a* and the discharge tube 120*b* by welding.

As described above, according to the present invention, since the first turbulent flow-generating member 130 is disposed inside the tube 110 in which the heat medium flows, and the second turbulent flow-generating member 140 is disposed inside each of the inflow tube 120*a* and the discharge tube 120*b* of the heat medium to promote the turbulent flow of the heat medium, boiling noises caused when the heat medium is locally overheated and adhesion of the foreign substances may be prevented to improve heat efficiency.

In the current embodiment, although the tube 110 has a rectangular shape, and each of the inflow tube 120*a* and the discharge tube 120*b* has a circular shape, the tube 110 may have a circular shape, and each of the inflow tube 120*a* and the discharge tube 120*b* may have a rectangular shape.

Hereinafter, components of the heat transfer fin 150 disposed in the heat exchanger 100 according to the present invention will be described.

Figure 13:
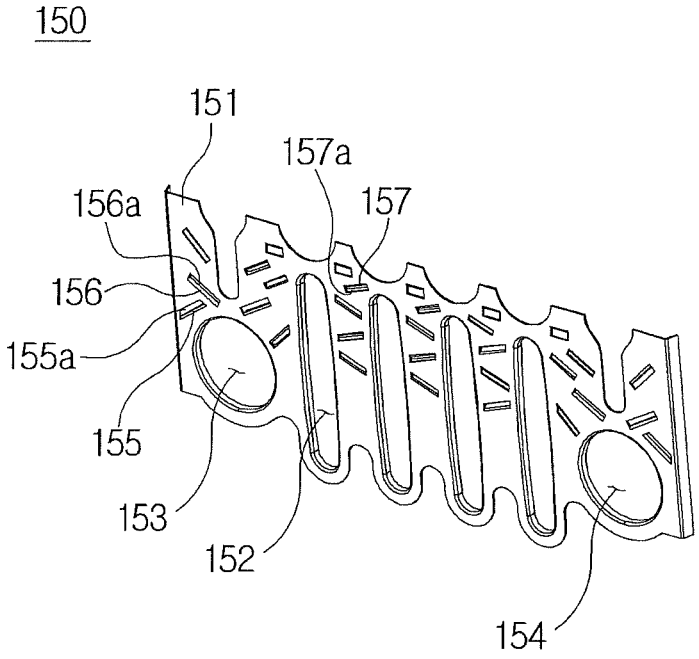
FIG. 13 is a perspective view of a heat transfer fin.

FIG. 13 is a perspective view of the heat transfer fin, and FIG. 14 is a view illustrating a flow of the fluid passing between the heat transfer fins. The heat transfer fin 150 according to the present invention includes a plurality of louvers 155, 156, and 157 for generating a turbulent flow in the combustion product passing between the heat transfer fins 150 disposed adjacent to each other.

A portion of a flat plate member 151 constituting the heat transfer fin 150 is cut to be bent in one direction to protrude to form the plurality of louvers 155, 156, and 157. The plurality of louvers 155, 156, and 157 having sizes and tilted angles different from each other along a flow direction of the combustion product. Thus, communication holes 155*a*, 156*a*, and 157*a* through which the fluid communicates with both spaces of the flat plate member 151 are defined in the cut portions. Thus, as illustrated in FIG. 14, the combustion product introduced into the space between the heat transfer fins 150 may be switched in flow direction in various directions by the louvers 155, 156, and 157 to promote the turbulent flow. At the same time, the combustion product may pass through the communication holes 155*a*, 156*a*, and 157*a* and be mixed into the space between the heat transfer fins 150 disposed adjacent to each other and thus be agitated in flow to further promote the turbulent flow.

Also, in the present invention, it is characterized in that the louvers 155, 156, and 157 are disposed only on an area C after a temperature boundary point B of the combustion product. That is, since in an area A before the temperature boundary point B, sufficient heat exchange is possible when the combustion product has a laminar flow, and the heat transfer fin 150 has a plane shape, the louvers 155, 156, and 157 may be disposed only on the area C after the temperature boundary point B to allow the turbulent flow of the combustion product to occur, thereby increasing heat exchange efficiency over an entire area of the heat transfer fin 150.

Also, since the louvers 155, 156, and 157 are disposed only on the area C after the temperature boundary point B, the combustion product may be reduced in flow resistance when compared to a case in which the louvers are disposed over the entire area of the heat transfer fin 150. Also, time and costs for processing the louvers may be reduced.

As described above, according to the present invention, the turbulent flow of the heat medium passing through the tubes 110, the inflow tube 120*a*, and the discharge tube 120*b* may occur by the first and second turbulent flow-generating members 130 and 140 to prevent boiling noises and adhesion of the foreign substances from occurring. Also, since the louvers 155, 156, and 157 having sizes and tilted angles different from each other are alternately disposed in the heat transfer fin 150, the turbulent flow of the combustion product may occur to improve heat exchange efficiency. Thus, since the heat exchanger increases in heat efficiency even though the installation number of the tubes 110 are reduced when compared to the prior art, the heat exchanger 100 may decrease in entire volume and thus be manufactured in a compact size.

The invention claimed is:

1. A fin-tube type heat exchanger comprising:

tubes through which a heat medium flows, the tubes being disposed in parallel at a predetermined distance to allow a combustion product to pass through a space therebetween; and heat transfer fins spaced apart from each other and coupled to outer surfaces of the tubes along a longitudinal direction so that the heat transfer fins are disposed parallel to a flow direction of the combustion product, wherein a first turbulent flow-generating member for generating a turbulent flow in the heat medium is disposed inside each of the tubes, wherein the first turbulent flow-generating member comprises:

a flat plate part disposed in the longitudinal direction of the tube to divide an inner space of the tube into two spaces;

a plurality of first guide pieces and a plurality of second guide pieces spaced apart from each other along the longitudinal direction to alternately protrude inclined from both side surfaces of the flat plate part; and a plurality of first communication holes and a plurality of second communication holes through which fluid communicates with both spaces of the flat plate part and disposed at adjacent to the plurality of first guide pieces and the plurality of second guide pieces, wherein a portion of the flat plate part is cut and bent in both directions of the flat plate part to form the first guide pieces and the second guide pieces, wherein the fluid communicates with both spaces of the flat plate part through the cut portions of the first guide pieces and the second guide pieces, wherein a heat medium inflow end of the first guide pieces are connected to a lower end of the flat plate part by a first connection piece, and simultaneously, the plurality of first communication holes are defined between the lower end of the flat plate part, the first connection piece, and the first guide pieces;

wherein a heat medium inflow end of the second guide pieces are connected to a upper end of the flat plate part by a second connection piece, and simultaneously, the plurality of second communication holes are defined between the upper end of the flat plate part, the second connection piece, and the second guide pieces, wherein a lower end of the first connection piece and a lower end of the first guide piece protrude downward at the lower end of the flat plate part, thereby coming into contact with the inner side of the tube, and then allowing the fluid to communicate through a space between the lower end of the flat plate part located among the plurality of first communication holes disposed adjacent to the plurality of first guide pieces and the inner side of the tube, and wherein an upper end of the second connection piece and an upper end of the second guide piece protrude upward at an upper end of the flat plate part, thereby coming into contact with the inner side of the tube, and then allowing the fluid to communicate through a space between the upper end of the flat plate part located among the plurality of second communication holes disposed adjacent to the plurality of second guide pieces and the inner side of the tube.

2. The fin-tube type heat exchanger of claim 1, wherein the first guide pieces are disposed inclined on one surface of the flat plate part so that the heat medium flows upward, the second guide pieces are disposed inclined on the other surface of the flat plate part so that the heat medium flows downward, and the heat medium introduced into the first guide pieces and the second guide pieces are successively guided to the second guide pieces and the first guide pieces disposed adjacent to an opposite surface of the flat plate part to alternately flow through both spaces of the flat plate part.

3. The fin-tube type heat exchanger of claim 2, wherein a heat medium discharge end of the first guide pieces is disposed at a height adjacent to the upper end of the flat plate part, and a heat medium discharge end of the second guide pieces is disposed at a height adjacent to the lower end of the flat plate part.

4. The fin-tube type heat exchanger of claim 1, wherein a third guide piece having a tilted angle that is different from that of the first guide pieces to cross the first guide pieces protrudes from one surface of the flat plate part, and a fourth guide piece having a tilted angle that is different from that of the second guide pieces to cross the second guide pieces protrudes from the other surface of the flat plate part.

5. The fin-tube type heat exchanger of claim 1, wherein welding parts protrude respectively from front and rear ends of the flat plate part in both directions and are welded and coupled to an inner surface of the tube.

6. The fin-tube type heat exchanger of claim 1, wherein an inflow tube and a discharge tube of the heat medium are disposed at both sides of the tubes, respectively, and a second turbulent flow-generating member for generating a turbulent flow of the heat medium is disposed in each of the inflow tube and the discharge tube, wherein the second turbulent flow-generating member comprises:

a plate member disposed in each of the inflow tube and the discharge tube in the longitudinal direction to vertically divide the inside of each of the inflow tube and the discharge tube; and first and second inclined parts spaced apart from each other along a flow direction of the heat medium and formed by cutting a portion of the plate member, the first and second inclined parts being alternately bent in different directions inclined in a vertical direction.

7. The fin-tube type heat exchanger of claim 6, wherein each of the first and second inclined parts disposed adjacent to each other along the flow direction of the heat medium are alternately inclined in upward and downward directions.

8. The fin-tube type heat exchanger of claim 1, wherein a plurality of louvers having sizes and tilted angles different from each other are disposed on each of the heat transfer fins along a flow direction of the combustion product introduced between the heat transfer fins disposed adjacent to each other.

9. The fin-tube type heat exchanger of claim 8, wherein a portion of the heat transfer fin is cut to be bent in one direction to form the plurality of louvers, and the fluid communicates with both sides of the heat transfer fin through the cut portions of the heat transfer fin.

10. The fin-tube type heat exchanger of claim 8, wherein the louvers are disposed on an area after a temperature boundary point of the combustion product.

11. The fin-tube type heat exchanger of claim 1, wherein each of the tubes has a rectangular cross section of which a side parallel to a flow direction of the combustion product has a length longer than that of a side of inflow and discharge-sides of the combustion product.

* * * * *